US007166364B2

(12) United States Patent
Bibber

(10) Patent No.: US 7,166,364 B2
(45) Date of Patent: Jan. 23, 2007

(54) POLYESTER CONVERSION COATED METAL OR ITS ALLOYS

(75) Inventor: John W. Bibber, Batavia, IL (US)

(73) Assignee: Sanchem, Inc., Chicago, IL (US)

( * ) Notice: Subject to any disclaimer, the term of this patent is extended or adjusted under 35 U.S.C. 154(b) by 0 days.

(21) Appl. No.: 11/109,136

(22) Filed: Apr. 19, 2005

(65) Prior Publication Data

US 2006/0234070 A1 Oct. 19, 2006

(51) Int. Cl.

| | |
|---|---|
| ***B32B 15/08*** | (2006.01) |
| ***B32B 15/18*** | (2006.01) |
| ***B32B 15/20*** | (2006.01) |
| ***B05D 3/02*** | (2006.01) |

(52) U.S. Cl. ..... 428/458; 428/626; 428/649; 428/650; 428/658; 428/681; 427/372.2; 427/388.1; 427/388.4

(58) Field of Classification Search ..... 428/626, 428/650, 649, 658, 681, 457, 458; 106/14.11, 106/14.13, 14.41; 427/372.2, 384, 385.5, 427/388.1, 388.4

See application file for complete search history.

(56) References Cited

U.S. PATENT DOCUMENTS 6,436,544 B1 * 8/2002 Veyrat et al. ..... 428/458

* cited by examiner

*Primary Examiner*—Michael E. LaVilla
(74) *Attorney, Agent, or Firm*—Barnes & Thornburg LLP; Robert F. I. Conte; James B. Conte

(57) ABSTRACT

I provide an aqueous coating composition to provide an outer protective coating for a metal selected from the group consisting of an aluminum, aluminum alloy, iron, iron alloy, zinc, zinc alloy, zinc coated iron, zinc coated iron alloy, and these metals and magnesium and magnesium alloys having a conversion coating thereon. The aqueous coating composition consists essentially of 60 to 90 parts by weight water, 0.5 to 10 parts by weight of a polyvinyl alcohol having a weight average molecular weight of at least 100,000 and being at least 95% hydrolyzed, 0.5 to 20 parts by weight of a polybasic acid or anhydride, and 0.0 to 3 parts by weight of a cross-linking agent or plasticizer to form a in-situ polyester conversion coating on the metal. The composition is applied directly to the metal or to the metal article which has a non-chromium conversion coating thereon and forms a thin film thereon. Then the metal with the film thereon is heated to between 300° to 550° F. to form an in-situ polyester conversion coating on the metal article.

12 Claims, No Drawings

POLYESTER CONVERSION COATED METAL OR ITS ALLOYS

FIELD OF INVENTION

The present invention relates to the application and generation of a non chromate, polyvinyl alcohol based polyester conversion coating. More particularly the present invention relates a polyester conversion coated aluminum, iron, zinc and their alloys and aluminum, iron, magnesium, and zinc and their alloys which have thereon a non-chromium conversion coating and wherein the polyester coating is applied as an aqueous solution of polyvinyl alcohol, a polybasic acid or anhydride, and if desired a cross-linking agent or plasticizer to form an in-situ polyester conversion coating on the metal wherein the metal itself is in the resulting polyester coating

BACKGROUND OF THE INVENTION

The chemical conversion coating of aluminum and its alloys, iron and its alloys, zinc and its alloys and zinc coated iron alloys is known in the art as a process whereby the surface of the metal is chemically converted to a surface that will more easily accept applied coatings, i.e. paint, and increases the corrosion resistance of the metal. The corrosion resistance aspect of the art is of particular importance in the aircraft industry as they frequently employ aluminum alloys that are easily corroded.

An accepted process involves the use of chromates or dichromates in conjunction with polyvinyl alcohol (see: Kirk-Othmer: Encyclopedia of Chemical Technology, volume 23, Third edition, Pages; 848–865) to generate in-situ a new polymer which consist of a network of various carbon to oxygen to chromium to oxygen to substrate metal bonds. As these are rather toxic, and have a considerable environmental concern, the chromate based conversion coatings are being displaced by less toxic materials. Alternative conversion coatings in current use which may be used are based upon potassium permanganate or zirconium compounds, either by themselves or incorporated in a polymer network.

SUMMARY OF THE INVENTION

This invention is directed towards the corrosion resistant characteristics of a polyvinyl alcohol derived polyester conversion coating formed in-situ on an aluminum or aluminum alloy surface, iron or iron alloy surface, zinc or zinc alloy surface, or on the surface selected from an aluminum or aluminum alloy surface, iron or iron alloy surface, zinc or zinc alloy surface, a magnesium or magnesium alloy surface which has an already existing conversion coated surface generated from permanganates or zirconium compounds. The preferred coating is water based and does not generate any volatile organic carbon compounds. In addition it contains no known toxic substances and will not generate any known toxic substances. The coating is very thin and as a result is sufficiently electrically conductive for use in aerospace applications unlike conventional polyester based coatings.

This invention provides an aqueous coating composition to provide an outer protective coating for a metal selected from aluminum, aluminum alloy, iron, iron alloy, zinc, zinc alloy, zinc coated iron, zinc coated iron alloy, and these metals and magnesium and magnesium alloys having a conversion coating thereon. The aqueous coating composition has essentially of 60 to 90 parts by weight water, 0.5 to 10 parts by weight of a polyvinyl alcohol having a weight average molecular weight of at least 100,000 and being at least 95% hydrolyzed, 0.5 to 20 parts by weight of a polybasic acid or anhydride, and 0.0 to 3 parts by weight of a cross-linking agent or plasticizer to form an in-situ polyester conversion coating on the metal.

This invention also provides the metal or metal article having thereon the in-situ polyester conversion coating provided by the in-situ polymerization of the above composition on the metal or metal article.

This invention further provides a process for treating the indicated metals and those with an existing conversion coating, by coating said substrate with a film of water-based solution of a polyvinyl alcohol and a polybasic acid and heating the coated substrates to a temperature of at least 300° F. for a sufficient period of time to form a polyester outer protective conversion coating on the substrate which incorporates the metal of the substrate itself in the polyester based coating.

DETAILED DESCRIPTION OF THE INVENTION

An aluminum or aluminum alloy, iron or iron alloy, zinc or zinc alloy or a zinc coated iron or iron alloy or magnesium or magnesium alloy is afforded corrosion resistant by having thereon an outer protective coating of a polyvinyl alcohol generated polyester conversion coating which incorporates the metal to which it is applied or the conversion coating which may have been previously applied to the metal in question.

The polyester conversion coatings are formed by the reaction of an aqueous polyvinyl alcohol solution with a polybasic acid in the presence of one of the metals mentioned above at a temperature of at least 300° F. but not to exceed 550° F. The polybasic acid will react with the metal substrate and then with the polyvinyl alcohol to produce a polyester that is also strongly bonded to the metal in question and includes the metal itself in the polymer network giving a very tightly adhering and corrosion resistant film.

To aid in the reaction the solution may contain various cross-linking agents, such as amino resins, to increase the rate of the reaction or lower the required reaction temperature. The mixture may also contain various plasticizers to provide for a more flexible film or wetting agents to give a more uniform and even coverage. The basic composition utilized to form the polyvinyl alcohol based polyester is a water based solution of:

0.5 to 20 parts by weight of a polybasic acid or anhydride 0.5 to 10 parts by weight polyvinyl alcohol to 3.0 parts by weight cross-linking agent or plasticizer The polybasic acid or anhydride preferably contains from eight to ten carbon atoms. A widely used organic polybasic acid for forming polyesters is the trimellitic acid also known as 1,2,4 benzenetricarboxylic acid or anhydride. This is generally sold and used as the anhydride because the dry form of the acid will revert to the anhydride. The material is relatively low in cost, rather reactive and has low melting point. Other useful polybasic acids and their anhydrides are isophthalic acid and 1,2,4,5 Benzenetetracarboxylic acid. In general most polybasic organic acids may be used.

The preferred polyvinyl alcohol is one that is at least 95 and preferably at least 98% hydrolyzed and has a weight average molecular weight of at least 100,000 and preferably at least 150,000.

The aqueous composition generally contains from 80% to 96% water and as such form a rather thin film that becomes much thinner when the polymerization reaction occurs. The coating may be applied by any suitable means such as immersion, brushing or spraying on the metals surface or the metals conversion coated surface. The coated surface is then heated to at least 300° F. for a period of time sufficient to effect polymer formation i.e. 1 to 10 minutes. The higher the temperature and the longer the heating is continued, the greater the degree of polymerization.

My polyester generated coatings include excellent paint adhesion due to the many highly polar polyester groups that are formed and good corrosion resistance The various types of permanganate conversion coatings are shown in my U.S. Pat. Nos. 4,711,667, 4,755,224, 4,878,963, 4,895,608, 5,358,623, 5,437,740, 5,554,231, 5,707,465 and these patents are incorporated herein.

The primary zirconium conversion coating for aluminum alloys is shown in U.S. Pat. No. 4,191,596 and this patent is incorporated herein.

The industry standard for conversion coatings, in terms of paint adhesion and corrosion resistance, is chromate. As such the corrosion resistance of the coatings was compared to that of standard chromate based conversion coatings whenever possible.

The aluminum alloy used in the following examples is cast "380" alloy as it represents an extreme example of corrosion susceptibility in that ASTM standard B449, "Chromate treatments on Aluminum" shows that one may only expect to get 48 hours of salt spray exposure (according to ASTM B117) before the appearance of "white corrosion". The aerospace alloy "2024-T3" is used in one example to illustrate the electrical conductivity of my conversion coatings and the effects of using other conversion coatings with this coating.

The zinc alloy used in these examples was "Zamak 3" which is the most widely use zinc casting available. ASTM standard B201, "Testing Chromate Coatings on Zinc and Cadmium Surfaces" suggest a minimum of 150 hours of salt spray exposure for the thickest (olive-drab) and most corrosion resistant of the applied chromate coatings The iron alloy used in these examples was carbon steel alloy 1010. It was used as it is the most commonly used alloy in extended corrosion and paint adhesion tests. There are no published unpainted salt spray corrosion test standards on mild carbon steel. The most widely used conversion coating system on mild steel is phosphating and phosphated mild steel panels are generally expected to withstand about 0.5 hours of exposure to a 3% salt spray (see: "Electrolytic and Chemical Conversion Coatings a Concise Survey of Their Production, Properties and Testing", by T. Biestek and J. Weber, Portcullis Press, Ltd., page 161)

The zinc coated panels used in the following examples were hot dip galvanized carbon steel alloy 1010. ASTM standard B201, "Testing Chromate Coatings on Zinc and Cadmium Surfaces" suggest a minimum of 150 hours of salt spray exposure for the thickest and most corrosion resistant of the applied chromate conversion coatings.

The polyvinyl alcohol used had a weight average molecular weight of 185,000 and was 99% hydrolyzed. This was labeled as Celvol and was purchased from Celanese Ltd., Dallas, Tex. 75381. The polybasic acids were purchased from Aldridge Chemical Co., Milwaukee, Wis. In all of the following examples the percentages are percentages by weight.

Pure magnesium and/or the most widely used of the magnesium alloys, "AZ 312B", was used in the following examples. Due to the extreme reactivity of magnesium and its alloys they were first treated with a permanganate or zirconium conversion coating at a pH of between 3.0 to 4.0 and then with the in-situ forming polyester composition which was maintained at a PH of 9.0 or higher. There are no published bare salt spray corrosion test for this metal or its alloys.

EXAMPLE 1

Two three inch by five inch panels of "1010" mild steel alloy was cleaned in a strongly alkaline cleaner at 150 to 160° F. for three minutes, rinsed with deionized water and coated with the following composition:

5.0% Polyvinyl alcohol
5.0% 1,2,4-Benzenetricarboxylic anhydride
90% dionized water and then cured at 300° F. for ten minutes. They were then cooled to room temperature and one of them placed in a salt spray chamber at 95° F. in accordance with ASTM standard B117 for 24 hours before the first signs of red rust appeared. The second panel was coated with a solvent based polyamid paint, allowed to dry for seven days and checked for adhesion according to ASTM standard D 3359. There was no loss of adhesion.

EXAMPLE 2

Two three inch by five inch panels of "1010" mild steel alloy was cleaned in a strongly alkaline cleaner at 150 to 160° F. for three minutes, rinsed with deionized water and coated with the following composition:

5.0% Polyvinyl alcohol
5.0% 1,2,4-Benzenetricarboxylic anhydride
90% dionized water and then cured at 550° F. for one minute. They were then cooled to room temperature and one of them placed in a salt spray chamber at 95° F. in accordance with ASTM standard B117 for 24 hours before the first signs of red rust appeared. The second panel was coated with a solvent based polyamid paint, allowed to dry for seven days and checked for adhesion according to ASTM standard D 3359. There was no loss of adhesion.

EXAMPLE 3

Two three inch by five inch panels of "1010" mild steel alloy was cleaned in a strongly alkaline cleaner at 150 to 160° F. for three minutes, rinsed with deionized water and coated with the following composition:

5.0% Polyvinyl alcohol
5.0% 1,2,4,5-Benzenetetracarboxylic acid
1.0% 2-amino-2methyl-1propanol
89% deionized water and then cured at 425° F. for three minutes. They were then cooled to room temperature and one of them placed in a salt spray chamber at 95° F. in accordance with ASTM standard B117 for 24 hours before the first signs of red rust appeared. The second panel was coated with a solvent based polyamid paint, allowed to dry for seven days and checked for adhesion according to ASTM standard D 3359. There was no loss of adhesion.

EXAMPLE 4

Two three inch by five inch panels of "1010" mild steel alloy was cleaned in a strongly alkaline cleaner at 150 to 160° F. for three minutes, rinsed with deionized water and coated with the following composition:

5.0% Polyvinyl alcohol 6.5% Phthalic acid

90% deionized water 1.0% 2-amino-2methyl-1propanol and then cured at 415° F. for three minutes. They were then cooled to room temperature and one of them placed in a salt spray chamber at 95° F. in accordance with ASTM standard B117 for 24 hours before the first signs of red rust appeared. The second panel was coated with a solvent based polyamid paint, allowed to dry for seven days and checked for adhesion according to ASTM standard D 3359. There was no loss of adhesion.

EXAMPLE 5

Two "380" cast aluminum alloy panels were cleaned in a mildly alkaline cleaning solution at 160 to 170° F. for three minutes, rinsed with deionized water and then deoxidized in a solution of 70% nitric acid and 1% ammonium bifluoride at room temperature for one minute and given a final rinse in deionized water. The panels were then coated with the following composition:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol

84% deionized water and then cured at 425° F. for five minutes. They were then cooled to room temperature and one of them placed in a salt spray at 95° F. according to ASTM specification B117 for 145 hours before the first signs of white corrosion appeared. The second panel was coated with a solvent based polyamid paint and allowed to dry for seven days. The paint adhesion was then tested according to ASTM standard D 3359. There was no loss of paint adhesion.

EXAMPLE 6

Two "ZAMAK 3" cast zinc alloy panels were cleaned in a mildly alkaline cleaning solution at 160 to 170° F. for three minutes, rinsed with deionized water and then deoxidized in a solution of 0.25% nitric acid at room temperature for one minute and given a final rinse in deionized water. The panels were then coated with the following composition:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol

84% deionized water and then cured at 425° F. for five minutes. They were then cooled to room temperature and one of them placed in a salt spray at 95° F. according to ASTM specification B117 for 150 hours before the first signs of white corrosion appeared. The second panel was coated with a solvent based polyamid paint and allowed to dry for seven days. The paint adhesion was then tested according to ASTM standard D 3359. There was no loss of paint adhesion.

EXAMPLE 7

Two "hot dip galvanized" 1010 alloy steel panels were cleaned in a mildly alkaline cleaning solution at 160 to 170° F. for three minutes, rinsed with deionized water and then deoxidized in a solution of 0.25% nitric acid at room temperature for one minute and given a final rinse in deionized water. The panels were then coated with the following composition:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol

84% deionized water and then cured at 425° F. for five minutes. They were then cooled to room temperature and one of them placed in a salt spray at 95° F. according to ASTM specification B117 for 150 hours before the first signs of white corrosion appeared. The second panel was coated with a solvent based polyamid paint and allowed to dry for seven days. The paint adhesion was then tested according to ASTM standard D 3359. There was no loss of paint adhesion.

EXAMPLE 8

Four "2024-T3" aluminum alloy panels were cleaned in a mildly alkaline cleaning solution at 160 to 170° F. for three minutes, rinsed with deionized water and then deoxidized in a solution of 25% nitric acid containing 1% ammonium bifluoride at room temperature for one minute and given a final rinse in deionized water. One of the panels were then directly coated with the following composition:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol

84% deionized water and then cured at 425° F. for five minutes. It was then cooled to room temperature and examined for electrical conductivity in accordance with military specification; "MIL-C-81706A" and found to meet their specifications with an average conductivity of 5,000 microhms per square inch at an applied pressure of 200 pounds per square inch. A second panel was first conversion coated with a permanganate based conversion coating composition, processed as indicated above and then placed in salt spray chamber at 95° F. for 336 hours according to ASTM specification B117. The panel showed no signs of corrosion and exceeded the requirements of military specification "MIL-C-5541E" in terms of salt spray corrosion resistance. A third panel was first conversion coated with the zirconium based conversion coating composition indicated in U.S. Pat. No. 4,191,596, processed as above and then exposed to a salt spray of 336 hours according to ASTM specification B117. This panel also exceeded the requirements of military specification "MIL-C-5541E" in terms of corrosion resistance. The fourth panel was first conversion coated with a permanganate based conversion coating, processed as above, painted with a standard solvent based polyamid paint, allowed to dry for seven days and then checked for adhesion as per ASTM standard D3359 and found to have no loss of paint adhesion.

EXAMPLE 9

Two pure magnesium panels and two "AZ 312 B" three inch by six inch magnesium alloy panels were cleaned in a mild alkaline cleaner at 160 degrees F., rinsed in D.I. water, deoxidized in a 0.2% nitric acid solution, rinsed, then conversion coated in a permanganate based conversion coating solution at a PH of 3.0, given a final rinse in D.I. water. The panels were then coated with the following solution:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol, to maintain the PH of the dried film at a PH above 9.0

84% deionized water dried, heated to 425 degrees F. for five minutes and then cooled to 70 degrees F. One magnesium alloy panels and one pure magnesium panels was placed in a salt spray run according to ASTM specification B 117 for four hours before observing the first signs of white corrosion. One of the pure magnesium panels and one of the magnesium alloy panels were coated with a polyamide water based primer, dried, allowed to cure, and tested for paint adhesion and salt spray resistance according to "Boeing Aircraft" specification "DMS 1786L" Both panels passed.

EXAMPLE 10

Two pure magnesium panels and two "AZ 312 B" three inch by six inch magnesium alloy panels were cleaned in a mild alkaline cleaner at 160 degrees F., rinsed in D.I. water, deoxidized in a 0.2% nitric acid solution and given a final rinse in D.I. water. One pure magnesium panel and one "AZ 312 B" alloy panel were then conversion coated with the zirconium based conversion coating composition indicated in U.S. Pat. No. 4,191,596 and given a final rinse in D.I. water. All the panels were then coated with the following solution:

4.0% polyvinyl alcohol 4.0% 1,2,4-Benzenetricarboxylic anhydride 7.0% of a 28% aqueous ammonia solution to adjust the PH to 9.5

1.0% 2-amino-2methyl-1propanol, to maintain the PH of the dried film at a PH above 9.0

84% deionized water dried, heated to 425 degrees F. for five minutes and then cooled to 70 degrees F. All of the panels were then coated with a polyamide water based primer, dried, allowed to cure, and tested for paint adhesion and salt spray resistance according to "Boeing Aircraft" specification "DMS 1786L" Both panels passed.

I claim:

1. A metal article wherein the metal is selected from the group consisting of an aluminum, aluminum alloy, iron, iron alloy, zinc, zinc alloy, zinc coated iron, zinc coated iron alloy, and the these metals and magnesium and magnesium alloys having a conversion coating; comprising said metal having thereon an in-situ polyester conversion coating formed from an aqueous coating composition consisting essentially of 60 to 90 parts by weight water, 0.5 to 10 parts by weight of a polyvinyl alcohol having a weight average molecular weight of at least 100,000 and being at least 95% hydrolyzed, 0.5 to 20 parts by weight of a polybasic acid or anhydride, and 0.0 to 3 parts by weight of a cross-linking agent or plasticizer to form the in-situ polyester conversion coating on the metal.

2. The article of claim 1 wherein the polybasic acid or anhydride has 8 to 10 carbon atoms and a benzene group.

3. The article of claim 2 wherein the polybasic acid is selected from the group consisting of trimellitic acid, isophthalic acid, 1,2,4,5 benzenetetracarboxylic acid, and the anhydrides thereof.

4. The article of claim 3 wherein the polyvinyl alcohol has a weight average molecular weight of at least 150,000 and is at least 98% hydrolyzed.

5. The article of claim 4 wherein the metal and the metal having a conversion coating thereon to be protected is selected from the group consisting of steel alloy, galvanized steel alloy, aluminum alloy, and zinc alloy; and the in-situ polyester conversion coating on the metal will provide corrosion resistance to the metal such that when the metal having a the conversion coating thereon is subjected to a salt fog at 95° F. for 24 hrs. the metal will show no signs of corrosion.

6. A process of preparing the article of claim 1 comprising treating a metal selected from the group consisting of an aluminum, aluminum alloy, iron, iron alloy, zinc, zinc alloy, zinc coated iron, zinc coated iron alloy, and these metals and magnesium and magnesium alloys having a conversion coating for corrosion resistance, comprising coating said metal with a film of an aqueous solution consisting essentially of 60 to 90 parts by weight water, 0.5 to 10 parts by weight of a polyvinyl alcohol having a weight average molecular weight of at least 100,000 and being at least 95% hydrolyzed, 0.5 to 20 parts by weight of a polybasic acid or anhydride, and 0.0 to 3 parts by weight of a cross-linking agent or plasticizer, and heating the metal having the film thereon at a temperature of at least 300° F. for a sufficient time to form an in-situ polyester conversion coating on the metal.

7. The process of claim 6 wherein the metal having the film thereon is heated to a temperature of between 300° F. to 550° F.

8. The process of claim 7 wherein the polybasic acid or anhydride has 8 to 10 carbon atoms and a benzene group.

9. The process of claim 8 wherein the polybasic acid is selected from the group consisting of trimellitic acid, isophthalic acid, 1,2,4,5 benzenetetracarboxylic acid, and the anhydrides thereof.

10. The process of claim 9 wherein the polyvinyl alcohol has a weight average molecular weight of at least 150,000 and is at least 98% hydrolyzed.

11. The process of claim 10 wherein the metal having the film thereon is heated for 1 to 10 minutes to form the in-situ polyester conversion coating on the metal.

12. The process of claim 10 wherein the metal and the metal having a conversion coating thereon to be protected is selected from the group consisting of steel alloy, galvanized steel alloy, aluminum alloy, and zinc alloy and the in-situ polyester conversion coating on the metal will provide corrosion resistance to the metal such that when the metal having the conversion coating thereon is subjected to a salt fog at 95° F. for 24 hrs. the metal will show no signs of corrosion.

* * * * *